US006880472B2

(12) United States Patent
Horiuchi

(10) Patent No.: US 6,880,472 B2
(45) Date of Patent: Apr. 19, 2005

(54) LOOPER THREADING APPARATUS FOR SEWING MACHINE

(75) Inventor: Toshio Horiuchi, Hiroshima (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/738,909

(22) Filed: Dec. 16, 2003

(65) Prior Publication Data

US 2004/0149192 A1 Aug. 5, 2004

(30) Foreign Application Priority Data

Dec. 17, 2002 (JP) ..... P2002-365218

(51) Int. Cl.[7] ..... D05B 57/00
(52) U.S. Cl. ..... 112/199
(58) Field of Search ..... 112/199, 225, 112/197, 200, 302, 224; 223/99

(56) References Cited

U.S. PATENT DOCUMENTS 4,557,408 A * 12/1985 Biemans ..... 223/99
5,076,181 A * 12/1991 Wang ..... 112/199
5,148,759 A * 9/1992 Wirth ..... 112/470.26
5,165,582 A * 11/1992 Andrews ..... 223/99
5,327,841 A * 7/1994 Sakuma ..... 112/162

FOREIGN PATENT DOCUMENTS

JP 6-277383 10/1994

* cited by examiner

*Primary Examiner*—Ismael Izaguirre
(74) *Attorney, Agent, or Firm*—Merchant & Gould P.C.

(57) ABSTRACT

A looper threading apparatus includes a threading member capable of holding a thread in a tip portion and inserting the thread through a thread hole, a guide member for movably accommodating the threading member and guiding the threading member to the thread hole, and a support member for supporting the guide member to freely approach and separate from the thread hole provided on an extended line of the threading member accommodated by the guide member. Moreover, there is provided a moving mechanism for moving the threading member and the guide member along an axis of the thread hole provided on the extended line. The moving mechanism moves the guide member and the threading member with respect to the thread hole provided on the extended line in such a manner that the tip portion of the threading member penetrates through the thread hole.

10 Claims, 8 Drawing Sheets

LOOPER THREADING APPARATUS FOR SEWING MACHINE

BACKGROUND OF THE INVENTION

The present invention relates to a looper threading apparatus for a sewing machine for threading for a thread hole provided on a looper to be swung in order to form a stitch in cooperation with the needle of the sewing machine.

Conventionally, an overcasting overlock sewing machine and a multi-thread chain stitch sewing machine comprise a looper for reciprocating while drawing an arcuate track to cross the track of a needle according to the vertical motion of the needle. A looper thread led by the looper forms a stitch together with a needle thread.

Threading for the looper is usually carried out manually by using a pair of tweezers. A thread hole formed on the looper is small. Therefore, a threading work imposes a burden, on an operator, and a working efficiency is not always high.

In recent years, in order to enhance the efficiency of the threading work for a looper, a looper threading apparatus for carrying out threading by utilizing an air flow has been developed as described in JP-A-06-277383 (Japanese Patent Application Publication Number: Hei06-277383), for example.

The looper threading apparatus has a special structure that a looper is pipe-shaped, and furthermore, a pipe-shaped component to be a passage for an air flow and a thread passage is provided, and the pipe-shaped structure is caused to pass by the air flow to guide a looper thread into the tube of the tubular looper and to cause the looper thread to the outlet of the tip of the looper when the looper thread is inserted from one of the ends of the pipe-shaped structure.

In the looper threading apparatus described in JP-A-06-277383, however, in some cases in which a foreign substance such as machine oil, a waste thread or dust enters a thread passage having a hollow structure, the inner portion of a pipe is clogged up and stagnated. Consequently, a predetermined air flow for leading out the thread cannot be obtained. As a result, there is a problem in that the thread cannot pass so that threading cannot be carried out or the foreign substance is stuck to the thread to be contaminated in the pipe.

While a thread guide and a thread tensioner are usually provided in the thread passage of the looper thread to influence a thread tension, furthermore, there is a problem in that the thread tension is affected so that a proper thread tension cannot be obtained and the quality of a sewn product is thereby deteriorated when the foreign substance is present in the pipe as described above.

Moreover, there is a problem in that a complicated work for removing these foreign substances from the inner part of the pipe and cleaning the dirty inner part of the pipe is required and a working efficiency is deteriorated.

SUMMARY OF THE INVENTION

It is an object of the invention to provide a looper threading apparatus in which there is no fear of the invasion of a foreign substance.

As shown in FIGS. 1 and 4, for example, a first aspect of the invention is directed to a looper threading apparatus (for example, a looper threading apparatus 1) for carrying out threading for a looper (for example, a lower looper 2 and an upper looper 3) having a thread hole (for example, thread holes 21 and 31) through which a thread (for example, a thread T) is inserted and swung interlockingly with a vertical motion of a needle, comprising:

a threading member (for example, threading members 8*a* and 8*b*) capable of holding the thread in a tip portion (for example, tip portions 81*a* and 81*b*) and inserting the thread through the thread hole;

a guide member (for example, guide members 7*a* and 7*b*) for movably accommodating the threading member therein and guiding the threading member to the thread hole;

a support member (for example, first support plates 4*a* and 4*b* and second support plates 6*a* and 6*b*) for supporting the guide member to freely approach and separate from the thread hole provided on an extended line of the threading member accommodated by the guide member; and a moving mechanism (for example, a pulse motor 9, a driving gear 91, a rotary gear 52, a first pulley 53, a second pulley 54 and a belt 56) for moving the threading member and the guide member along an axis of the thread hole provided on the extended line, wherein the moving mechanism moves the guide member and the threading member with respect to the thread hole provided on the extended line in such a manner that the tip portion of the threading member penetrates through the thread hole.

According to the first aspect of the invention, the moving mechanism moves the guide member and the threading member with respect to the thread hole provided on the extended line of the threading member so that the tip portion of the threading member penetrates through the thread hole. The tip portion of the threading member thus penetrating is caused to hold the thread and the moving mechanism separates the threading member and the guide member from the thread hole in the exact condition to extract the tip portion from the thread hole so that the thread is also inserted through the thread hole following the operation. In other words, even if an operator does not directly insert the thread through the thread hole by a manual work, the thread can be automatically inserted through the thread hole by simply causing the tip portion of the threading member to hold the thread. Thus, the threading can be carried out without utilizing an air pressure. Consequently, there is no fear of the invasion of a foreign substance and the threading work can be carried out efficiently.

As shown in FIGS. 1 and 4, for example, a second aspect of the invention is directed to the looper threading apparatus according to the first aspect of the invention, wherein the tip portion of the threading member is formed like a closed loop to be extendable, and the support member includes a plurality of support portions (for example, through holes 41*a* and 41*b* and through holes 61*a* and 61*b*) for supporting the guide member in order to support the guide member in a plurality of points on a moving path for the guide member.

According to the second aspect of the invention, the tip portion of the threading member is formed like the extendable closed loop. Even if the tip portion has a larger outer shape than the outer shape of the thread hole, therefore, it can penetrate through the thread hole. After the penetration, furthermore, the tip portion is restored to have an original shape. Therefore, the thread can easily be held so that a workability can be enhanced.

Moreover, the support member is provided with a plurality of support portions for supporting the guide member. Therefore, the movement of the guide member can be stabilized.

As shown in FIG. 1, for example, a third aspect of the invention is directed to the looper threading apparatus according to the first or second aspect of the invention, wherein an advance regulating member (for example, advance regulating members 73*a* and 73*b*) for coming in contact with at least one of the support portions to regulate an advance of the guide member is fixed to the guide member in order to cause the guide member and the thread hole to be close to each other at a predetermined interval.

According to the third aspect of the invention, the advance regulating member for coming in contact with at least one of the support portions to regulate the advance of the guide member is fixed to the guide member in order to cause the guide member and the thread hole to be close to each other at a predetermined interval. Therefore, the advance position of the guide member can be set and the guide member can be reliably caused to approach the thread hole. Accordingly, it is possible to prevent the guide member from being excessively advanced and to prevent the looper from being pressed by the guide member.

As shown in FIG. 1, for example, a fourth aspect of the invention is directed to the looper threading apparatus according to any of the first to third aspects of the invention, wherein a retreat regulating member (for example, retreat regulating members 71*a* and 71*b*) for coming in contact with at least one of the support portions to regulate a retreat of the guide member is fixed to the guide member in such a manner that the guide member and the thread hole are separated from each other at a predetermined interval.

According to the fourth aspect of the invention, the retreat regulating member for coming in contact with at least one of the support portions to regulate the retreat of the guide member is fixed to the guide member in order to separate the guide member and the thread hole from each other at a predetermined interval. Therefore, the retreat position of the guide member can be set and the guide member can be prevented from being dropped from the support portion in the retreat.

As shown in FIG. 1, for example, a fifth aspect of the invention is directed to the looper threading apparatus according to the fourth aspect of the invention, wherein the advance regulating member is provided behind a rear one of the support portions and the retreat regulating member is provided in such a manner that at least one of the support members is positioned therebefore, the threading member includes a transmitting member (for example, a transmitting member 82*a*) for transmitting a movement carried out by the moving mechanism to the guide member, and an advancing elastic member (for example, second springs 83*a* and 83*b*) having an elasticity is provided between the advance regulating member and the transmitting member, and a retreating elastic member (for example, first springs 72*a* and 72*b*) having the elasticity is provided between the support member positioned before the retreat regulating member and the retreat regulating member.

According to the fifth aspect of the invention, the advancing elastic member having the elasticity is provided between the advance regulating member and the transmitting member. When the threading member is advanced by the moving mechanism, therefore, the transmitting member presses the advance regulating member through the advancing elastic member with the advance. By the pressing, the guide member can be advanced. In this case, the retreat regulating member is also advanced so that the retreating elastic member is elastically deformed. When the threading member is retreated by the moving mechanism, then, the press of the advance regulating member by the transmitting member is released so that the guide member tries to stay in that place. However, the retreating elastic member is elastically restored to push the retreat regulating member rearward. Consequently, the guide member is also retreated. Thus, only the threading member is moved so that the guide member can also be moved longitudinally.

As shown in FIG. 1, for example, a sixth aspect of the invention is directed to the looper threading apparatus according to any of the first to fifth aspects of the invention, wherein the moving mechanism includes:

a motor (for example, the pulse motor 9);

a first pulley (for example, the first pulley 53) to be rotated and driven by the motor;

a second pulley (for example, the second pulley 55) which is provided apart from the first pulley and is rotatable;

a belt (for example, the belt 56) provided over the first pulley and the second pulley; and an engaging member (for example, engaging members 84*a* and 84*b*) for fixing the threading member to the belt in order to freely adjust a position.

According to the sixth aspect of the invention, the threading member is fixed to the belt by means of the engaging member. Even if a runout is generated in the threading member and the guide member, therefore, the belt can fluctuate according to the runout, thereby correcting their runout.

As shown in FIG. 4, for example, a seventh aspect of the invention is directed to the looper threading apparatus according to any of the second to sixth aspects of the invention, wherein the thread hole is formed like a slot in an almost horizontal direction in such a manner that the tip portion taking a shape of the closed loop is almost horizontal when the threading member is inserted therethrough.

The looper is usually provided below an operator's eyes. When the threading is to be carried out, therefore, the operator turns the eyes downward. For this reason, if the thread hole takes the shape of the slot in almost the horizontal direction in such a manner that the tip portion taking the shape of the closed loop is almost horizontal when the threading member is inserted, the operator sees the tip portion taking the shape of the closed loop to be the largest. Consequently, it is possible to easily carry-out the work for causing the tip portion to hold the thread.

As shown in FIG. 4, for example, an eighth aspect of the invention is directed to the looper threading apparatus according to any of the first to seventh aspects of the invention, wherein the tip portion of the threading member has a different color from colors of members provided in the vicinity of the thread hole.

According to the eighth aspect of the invention, the tip portion of the threading member has the different color from the colors of the members provided in the vicinity of the thread hole. Therefore, the tip portion is conspicuous. Consequently, the operator can grasp the position of the tip portion at a glance.

A ninth aspect of the invention is directed to the looper threading apparatus according to any of the first to eighth aspects of the invention, wherein when a plurality of loopers is provided, the threading member, the guide member and the support member are provided in plural sets for each of the loopers.

According to the ninth aspect of the invention, if a plurality of loopers is provided, the threading member, the guide member and the support member are provided in plural sets for each of the loopers. Therefore, the threading can be carried out for the loopers in a short time.

A tenth aspect of the invention is directed to the looper threading apparatus according to the ninth aspect of the invention, wherein the threading members are moved by one moving mechanism.

According to the tenth aspect of the invention, the threading members are moved by one moving mechanism. Therefore, it is possible to decrease a size and to reduce a cost.

Figure 1:
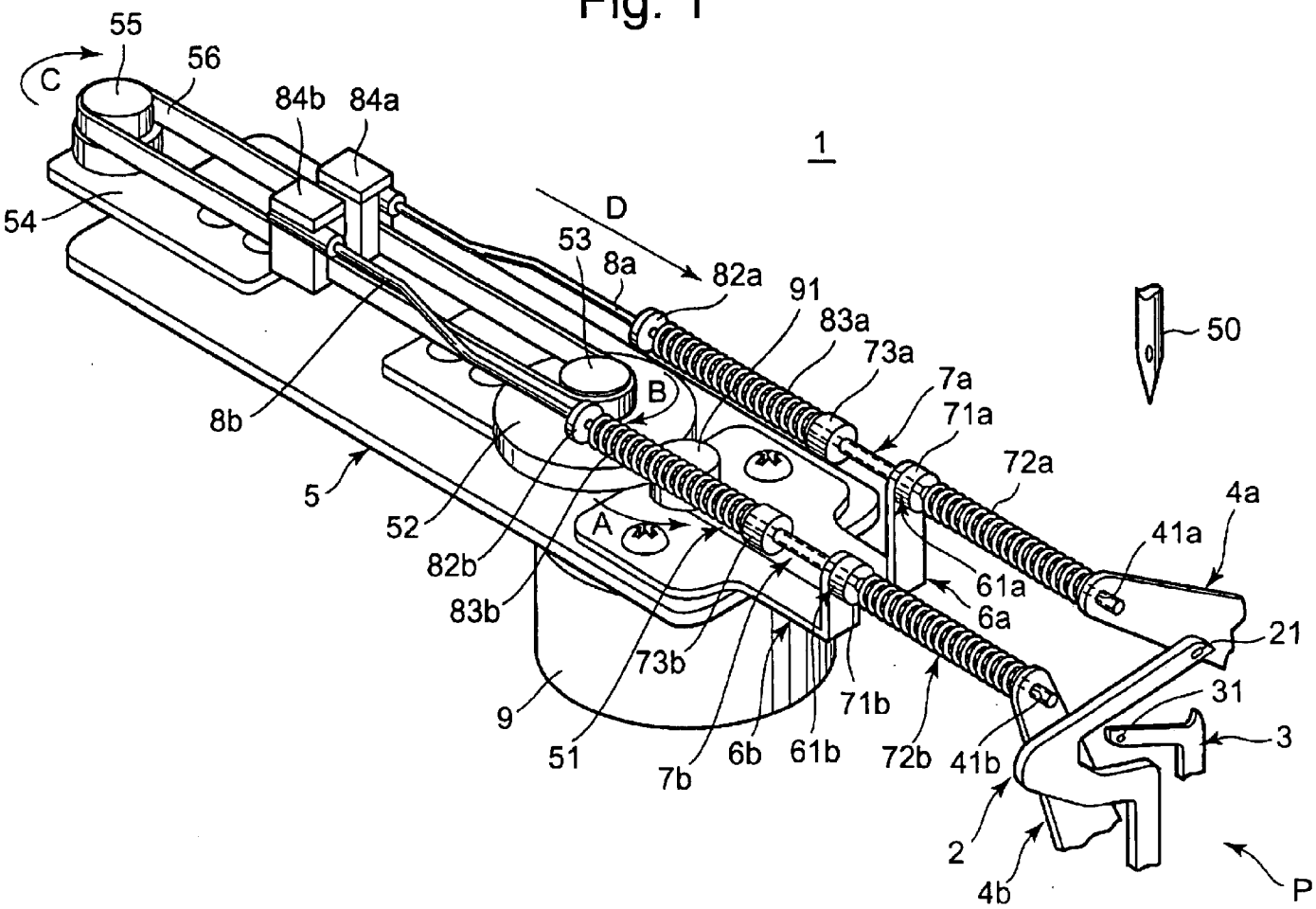
FIG. 1 is a perspective view showing a specific manner of a looper threading apparatus according to the invention.

Note that in the drawings, reference numerals 1 denotes a looper threading apparatus, 2 a lower looper (looper), 3 a upper looper (looper), 4*a* and 4*b* a first support plate (support member), 6*a* and 6*b* a second support plate (support member), 7*a* and 7*b* a guide member, 8*a* and 8*b* a threading member, 9 a motor, 21 a thread hole, 31 a thread hole, 41*a* and 41*b* a through hole (support portion), 53 a first pulley, 55 a second pulley, 56 a belt, 61*a* and 61*b* a through hole (support portion), 71*a* and 71*b* a retreat regulating member, 72*a* and 72*b* a first spring (retreating elastic member), 73*a* and 73*b* an advance regulating member, 81*a* and 81*b* a catching portion, 83*a* and 83*b* a second spring (advancing elastic member), 82 a transmitting member, and T a thread.

DESCRIPTION OF THE PREFERRED EMBODIMENT

[First Embodiment]

A looper threading apparatus for a sewing machine according to embodiments will be described with reference to FIG. 1 to FIG. 5 and FIG. 9 to FIG. 11.

Figure 9:
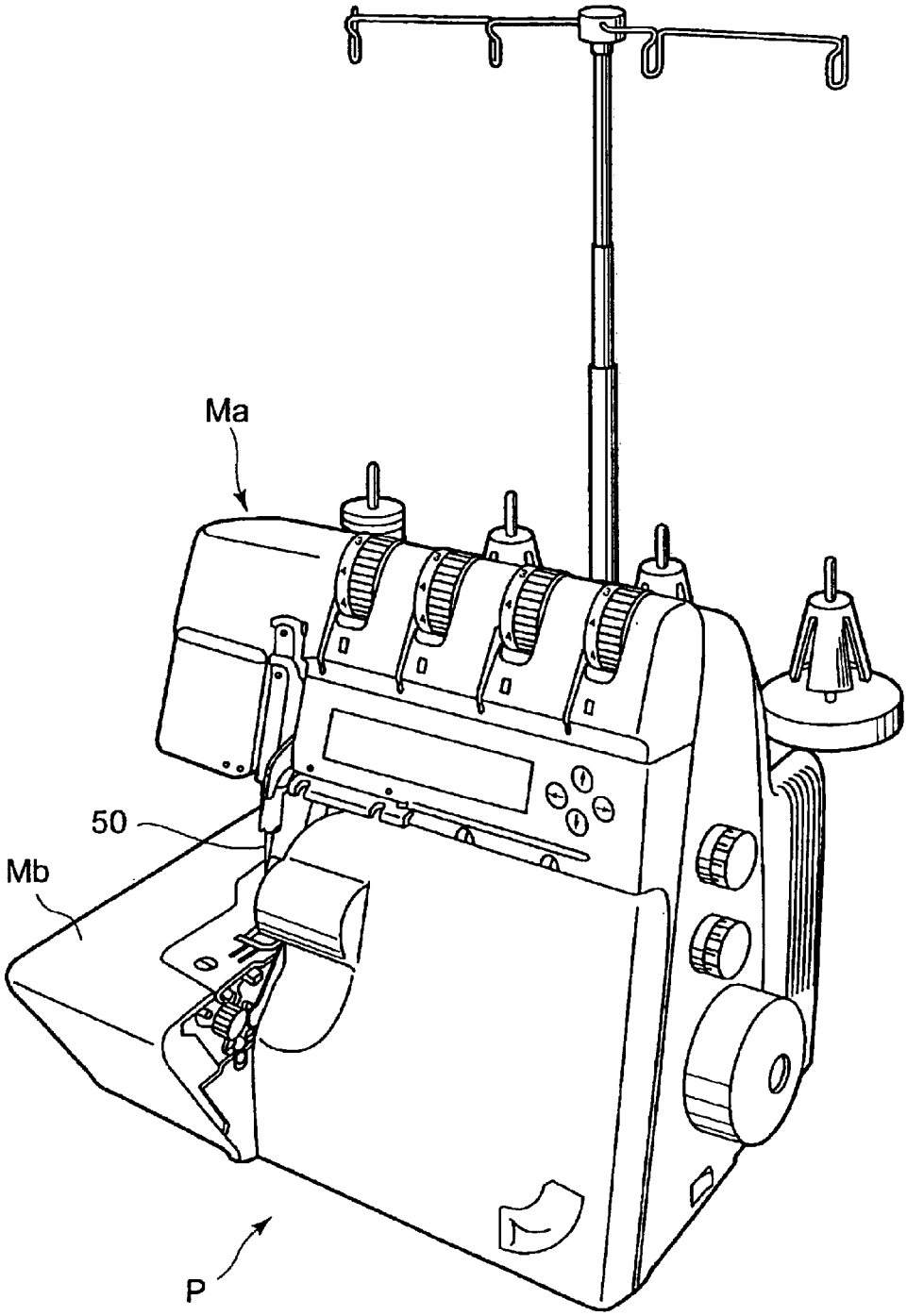
FIG. 9 is a perspective view showing a domestic overlock sewing machine according to the embodiment.

In a domestic overcasting sewing machine to be a sewing machine according to the embodiment, as shown in FIG. 9 and FIG. 1, a sewing machine body portion Ma and a bed portion Mb are provided on right and left sides respectively as seen from an operator side (an arrow P), and a needle 50 to be vertically moved interlockingly with the main shaft of the sewing machine which is not shown and a lower looper 2 and an upper looper 3 which are swung interlockingly with the main shaft of the sewing machine are provided on the sewing machine body portion Ma side, and a stitch can be formed by the cooperation of the needle 50 and the lower looper 2 and upper looper 3. The tips of the lower looper 2 and the upper looper 3 have slot-shaped thread holes 21 and 31 through which the thread is inserted, respectively. A looper threading apparatus 1 is provided on an inner side seen from the operator side with respect to the lower looper 2 and the upper looper 3, that is, the forward side of the arrow P at the sewing machine body portion Ma side, and serves to carry out threading for the thread holes 21 and 31 of the loopers 2 and 3.

The looper threading apparatus 1 comprises two first support plates 4*a* and 4*b* fixed to a frame, a chassis or a cover (not shown) of the sewing machine. Two first support plates 4*a* and 4*b* including through holes 41*a* and 41*b* are provided close to each other on the forward side of the arrow P along the swinging paths of the lower looper 2 and the upper looper 3. The through holes 41*a* and 41*b* are formed on the tips of the first support plates 4*a* and 4*b*. When the lower looper 2 and the upper looper 3 are placed and stopped in threading positions, the thread holes 21 and 31 are provided to be opposed to the through holes 41*a* and 41*b* on the same axis as the centers of the through holes 41*a* and 41*b*.

The looper threading apparatus 1 comprises a plate-shaped body member 5 fixed to a machine frame. Second support plates 6*a* and 6*b* having tips bent upward to be opposed to the first support plates 4*a* and 4*b* are fixed to the surface (upper surface) of the body member 5. Through holes 61*a* and 61*b* are formed on the upper ends of the bent portions so as to be positioned on the same axis as the through holes 41*a* and 41*b* of the first support plates 4*a* and 4*b*, respectively.

A plurality of tubular guide members 7*a* and 7*b* provided in parallel penetrate through the through holes 41*a* and 41*b* of the first support plates 4*a* and 4*b* and the through holes 61*a* and 61*b* of the second support plates 6*a* and 6*b* in parallel and movably in an axial direction. In other words, the guide members 7*a* and 7*b* are supported by the first support plates 4*a* and 4*b* and the second support plates 6*a* and 6*b* in order to freely approach and separate from the thread holes 21 and 31 of the lower looper 2 and the upper looper 3 provided in the threading positions.

Retreat regulating members 71*a* and 71*b* for coming in contact with the front surfaces of the erected portions of the second support plates 6*a* and 6*b* to regulate the retreat of the guide members 7*a* and 7*b* are fixed to the outer peripheries of the guide members 7*a* and 7*b* on this side of the second support plates 6*a* and 6*b* (the first support plate 4*a* and 4*b* sides) at the forward side (right side in the drawing) of the second support plates 6*a* and 6*b*. First springs 72*a* and 72*b* are provided on the guide members 7*a* and 7*b* between the retreat regulating members 71*a* and 71*b* and the first support plates 4*a* and 4*b*.

Moreover, advance regulating members 73*a* and 73*b* for coming in contact with the rear surfaces of the second support plates 6*a* and 6*b* to regulate the advance of the guide members 7*a* and 7*b* are fixed to the outer peripheries of the guide members 7*a* and 7*b* isolated from the retreat regulating members 71*a* and 71*b* with the second support plates 6*a* and 6*b* provided therebetween at the rearward side (left side in the drawing) of the second support plates 6*a* and 6*b*.

Threading members 8*a* and 8*b* to be inserted through the thread holes 21 and 31 of the lower looper 2 and the upper looper 3 provided in the threading positions are accommodated in the tubes of the guide members 7*a* and 7*b* movably in an axial direction.

Figure 3:
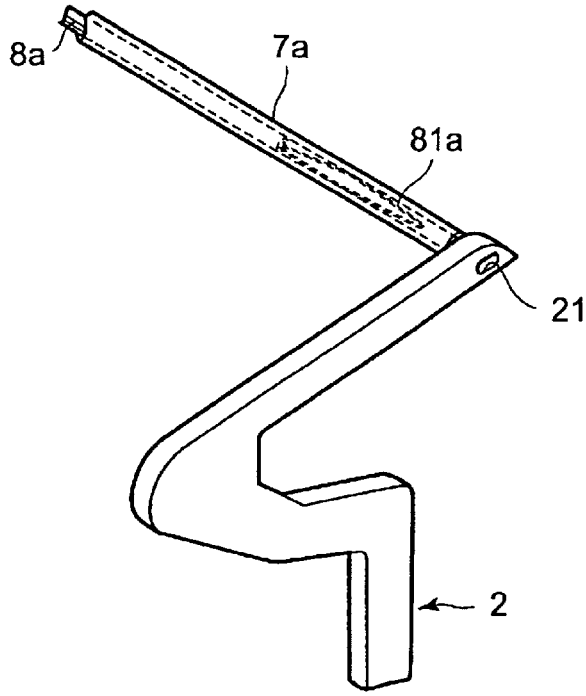
FIG. 3 is a perspective view showing a state in which a threading member and a guide member provided in the looper threading apparatus in FIG. 1 are close to a thread hole.
Figure 4:
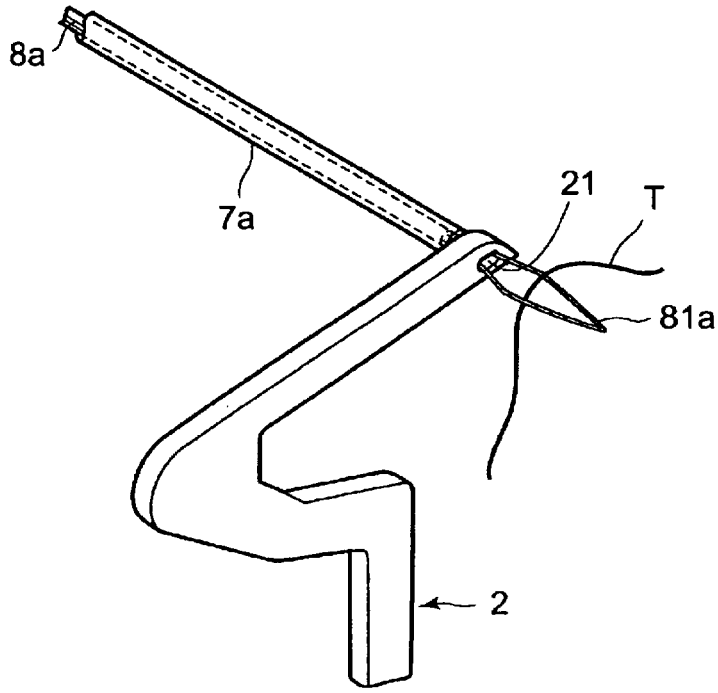
FIG. 4 is a perspective view showing a state in which the catching portion of the threading member in FIG. 3 is inserted through the thread hole.

The tips of the threading members 8*a* and 8*b* constituted by a rod-shaped rigid body are provided with catching portions (tip portions) 81*a* and 81*b* formed of a thin and flexible wire. The catching portions 81*a* and 81*b* have a different color from the colors of members provided in the vicinity of the thread holes 21 and 31, and are contracted and accommodated to reduce widths in the guide members 7*a* and 7*b* as shown in FIG. 3 and are extendably formed like a closed loop in such a manner that they are extended to increase the widths and are thus restored to have original shapes as shown in FIG. 4 when they are protruded from the guide members 7*a* and 7*b*.

Disk-shaped transmitting members 82*a* and 82*b* are fixed to the rear portions of the regulating members 73*a* and 73*b* on the threading members 8*a* and 8*b* isolated by the advance regulating members 73*a* and 73*b*. Second springs 83*a* and 83*b* are provided on the threading members 8*a* and 8*b* between the transmitting members 82*a* and 82*b* and the advance regulating members 73*a* and 73*b* in such a manner that end faces come in contact with both of them. The second springs 83*a* and 83*b* have greater loads than those of the first springs 72*a* and 72*b* or are set to have greater loads than those of the first springs 72*a* and 72*b*.

Moreover, clip-shaped engaging members 84*a* and 84*b* are fixed to the rear ends of the threading members 8*a* and 8*b*.

A pulse motor 9 to be a driving source is fixed to the back (lower) face side of the body member 5, and a rotary shaft (not shown) is provided to be protruded upward from a portion 51 between both of the support plates 6*a* and 6*b* above the body member 5 and a driving gear 91 is fixed to the upper end of the rotary shaft.

A rotary gear 52 to be mated with the driving gear 91 is rotatably provided on the surface side of the body member 5. A first pulley 53 having a smaller diameter than the diameter of the rotary gear 52 is fixed coaxially to the upper surface of the rotary gear 52.

A support plate 54 extended rearward is fixed to a rear end on the surface side of the body member 5. A second pulley 55 which is rotatable is provided in the extended portion of the support plate 54 to be opposed to the first pulley 53. A loop belt 56 is provided over the first pulley 53 and the second pulley 55, and the power of the pulse motor 9 is transmitted to the belt 56 through the driving gear 91, the rotary gear 52, the first pulley 53 and the second pulley 55.

The rear ends of the threading members 8*a* and 8*b* are fixed to the belt 56 through the engaging members 84*a* and 84*b* to freely adjust positions in an axial direction. The engaging members 84*a* and 84*b* interpose the belt 56 therebetween, thereby fixing the threading members 8*a* and 8*b* to the belt 56. By releasing the interposition, the positions of the threading members 8*a* and 8*b* can be adjusted.

Figure 10:
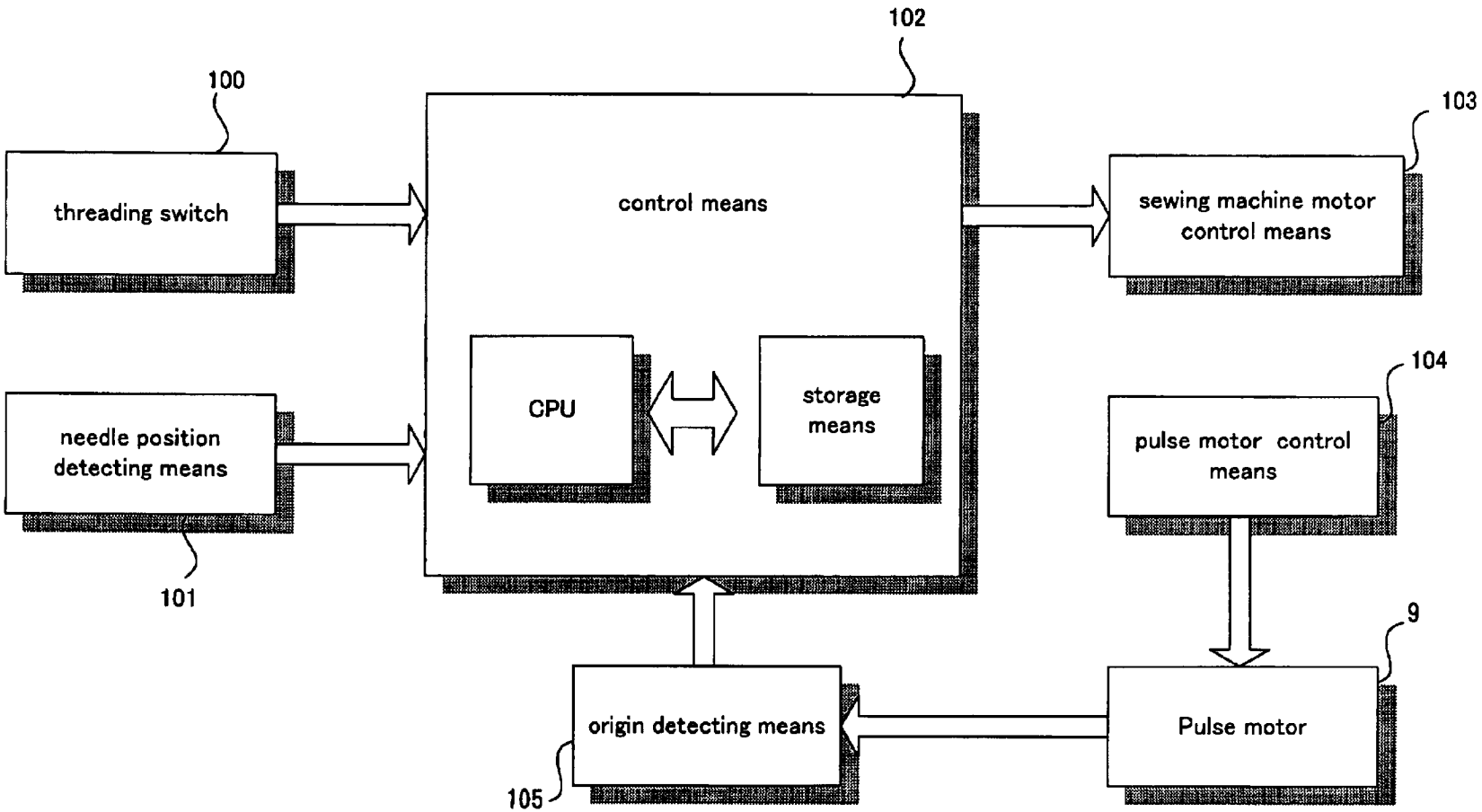
FIG. 10 is a control block diagram showing the execution of a control according to the embodiment.
Figure 11:
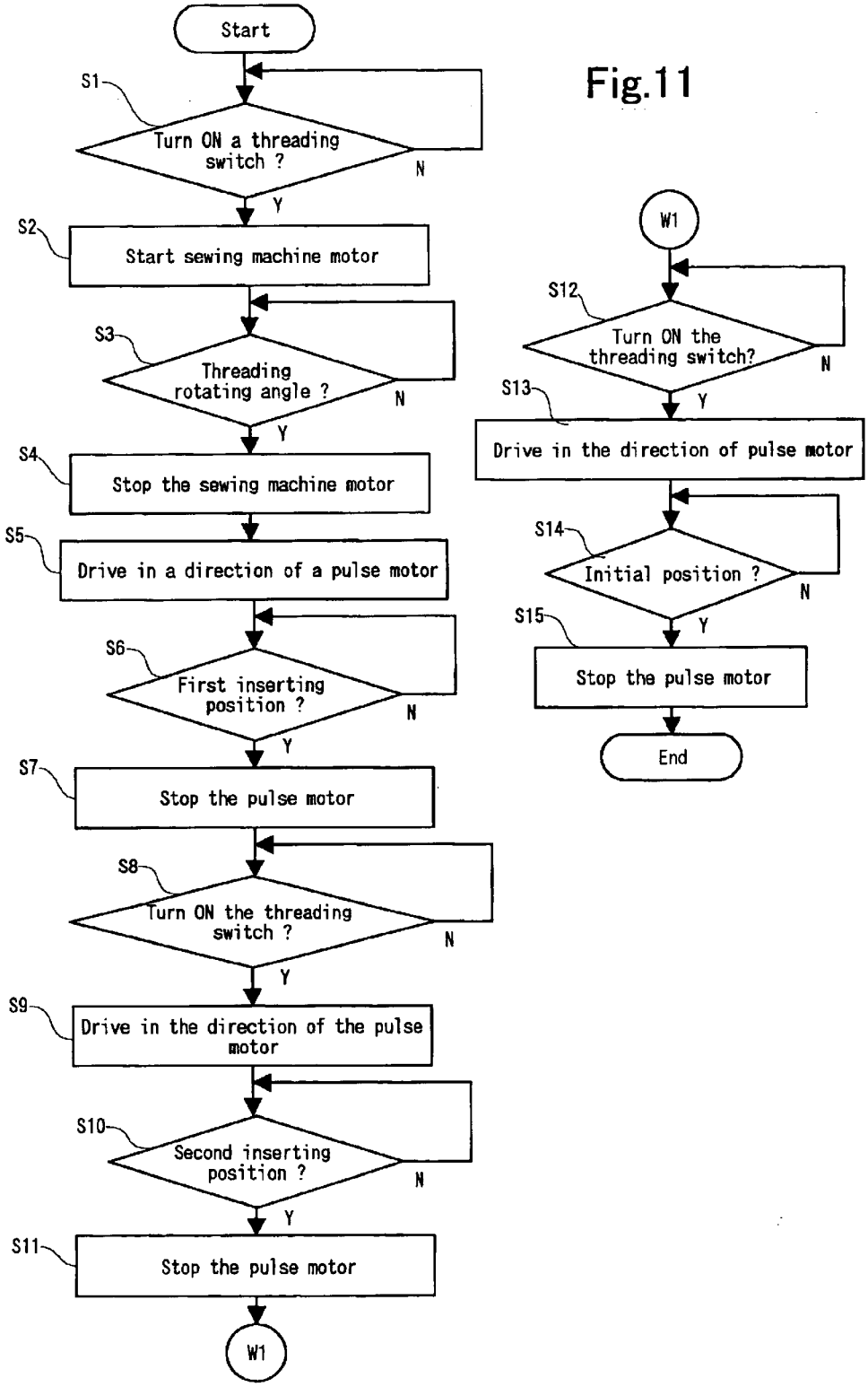
FIG. 11 is a flow chart showing the control according to the embodiment.

Next, a block circuit diagram in FIG. 10 will be described.

A threading switch 100 is provided in a proper portion on the front surface of the sewing machine and is turned ON to generate a signal every time it is pressed.

Needle position detecting means 101 is provided on a main shaft (not shown) of the sewing machine and serves to detect the rotating angle of the main shaft of the sewing machine to reach the upper and lower stop positions of the sewing machine needle 50 or the threading positions in which the thread holes 21 and 31 of the lower looper 2 and the upper looper 3 are opposed to the threading members 8*a* and 8*b*, and to generate respective signals.

Control means 102 is constituted by storage means for storing data of the control system of the sewing machine, and a CPU for inputting the signal of the threading switch 100 or the needle position detecting means 101 and the signal of a sewing machine starting and stopping operation switch which is not shown, thereby reading the data of the storage means and controlling various devices.

Sewing machine motor control means 103 controls a sewing machine motor coupled to the main shaft of the sewing machine based on the control of the control means 102, and carries out an operation for driving the sewing machine motor and stopping the same sewing machine motor in the needle upper and lower stop positions and the threading position in relation to the operation of the sewing machine starting and stopping operation switch or the operation of the threading switch 100.

Pulse motor control means 104 controls the driving operation of the pulse motor 9 based on the output of origin detecting means 105 provided in the pulse motor 9 of the looper threading device 1 and a command sent from the control means 102.

Next, the function and operation of the looper threading apparatus 1 according to the embodiment will be described with reference to FIGS. 1 to 5 and 11.

First of all, in the case in which the threading is to be carried out, the threading switch 100 is operated (S1) so that the sewing machine motor control means 103 drives the sewing machine motor at a low speed (S2). When there are reached the threading positions in which the thread holes 21 and 31 of the lower looper 2 and the upper looper 3 are provided opposite onto the extended lines of the threading members 8*a* and 8*b* as shown in FIG. 1, a predetermined detection signal is generated from the needle position detecting means 101 (S3) and the sewing machine is stopped by a sewing machine motor control circuit (S4). When the lower looper 2 and the upper looper 3 are provided in the threading positions, the thread holes 21 and 31 taking the shapes of the slot are arranged in almost a horizontal direction.

When the lower looper 2 is provided in the threading position, the pulse motor 9 is driven (S5) to rotate the driving gear 91 in an A direction and to rotate the rotary gear 52 and the first pulley 53 in a B direction. By the rotation of the first pulley 53, then, the belt 56 is rotated in a C direction to move the threading member 8*a* in a D direction (forward).

Figure 2:
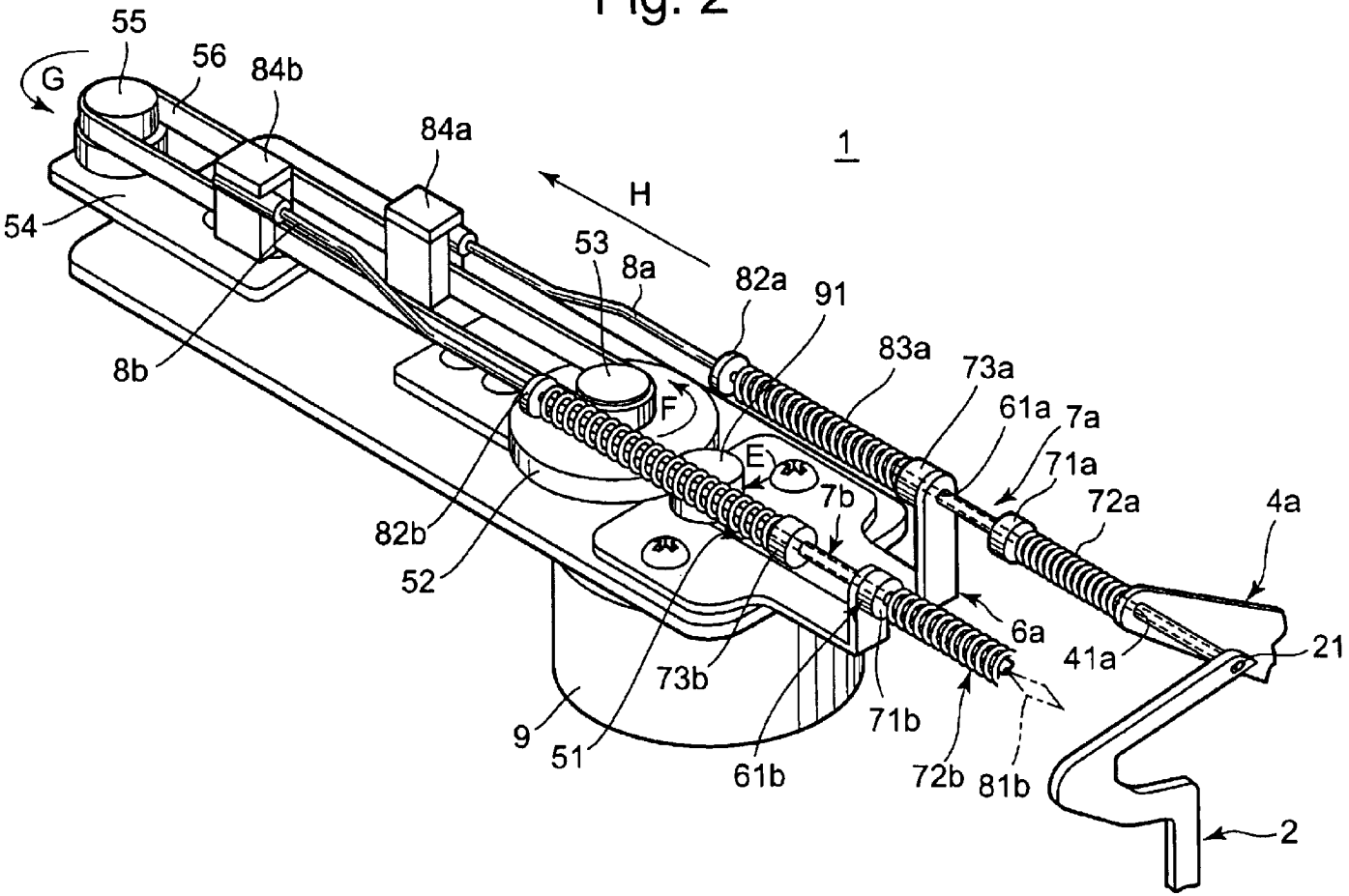
FIG. 2 is a perspective view illustrating an operation procedure for the looper threading apparatus in FIG. 1.

When the threading member 8*a* is moved forward, the transmitting member 82*a* presses the advance regulating member 73*a* through the second spring 83*a* so that the guide member 7*a* and the retreat regulating member 71*a* are also advanced according to the advance of the threading member 8*a*. At this time, the second spring 83*a* has a greater load than the load of the first spring 72*a*. As shown in FIG. 2, therefore, the first spring 72*a* is contracted by the advance of the retreat regulating member 71*a* earlier before the second spring 83*a* is contracted. When the advance regulating member 73*a* comes in contact with the second support plate 6*a* by the advance, the advance of the guide member 7*a* is regulated. In this case, the tip portion of the guide member 7*a* is close to the thread hole 21 of the lower looper 2 provided in the threading position as shown in FIG. 3.

When the pulse motor 9 is driven so that the threading member 8*a* is advanced, furthermore, the transmitting member 82*a* pushes and contracts the second spring 83*a*, and at the same time, the catching portion 81*a* of the threading member 8*a* is protruded from the tip of the guide member 7*a* as shown in FIG. 4 and penetrates through the thread hole 21 of the lower looper 2, and is thus protruded toward an opposite side. By the output of the origin detecting means 105 when a first inserting position is reached (S6), the pulse motor 9 is stopped (S7).

In this case, the shape of the catching portion 81*a* accommodated in the guide member 7*a* has a smaller width than the width of the thread hole 21. Consequently, the catching portion 81*a* can smoothly penetrate through the thread hole 21 and can be thus protruded and inserted toward the opposite side. Moreover, the major axis of the thread hole 21 is almost horizontal. Therefore, the catching portion 81*a* of the threading member 8*a* is provided almost horizontally.

Then, an operator inserts a thread T through the catching portion 81*a* penetrating through and protruded from the thread hole 21 of the lower looper 2. In this case, the catching portion 81*a* is provided almost horizontally as described above. Therefore, the operator sees the catching portion 81*a* to be the largest and can easily insert the thread T through the catching portion 81*a*.

After the thread T is inserted through the catching portion 81*a*, the threading switch 100 is operated again (S8). As shown in FIG. 2, consequently, the pulse motor 9 is driven in a reverse direction (S9) and the driving gear 91 is rotated in an E direction, and the rotary gear 52 and the first pulley 53 are rotated in an F direction. By the rotation of the first pulley 53, the belt 56 is rotated in a G direction so that the threading member 8*a* is moved in an H direction (rearward).

Figure 5:
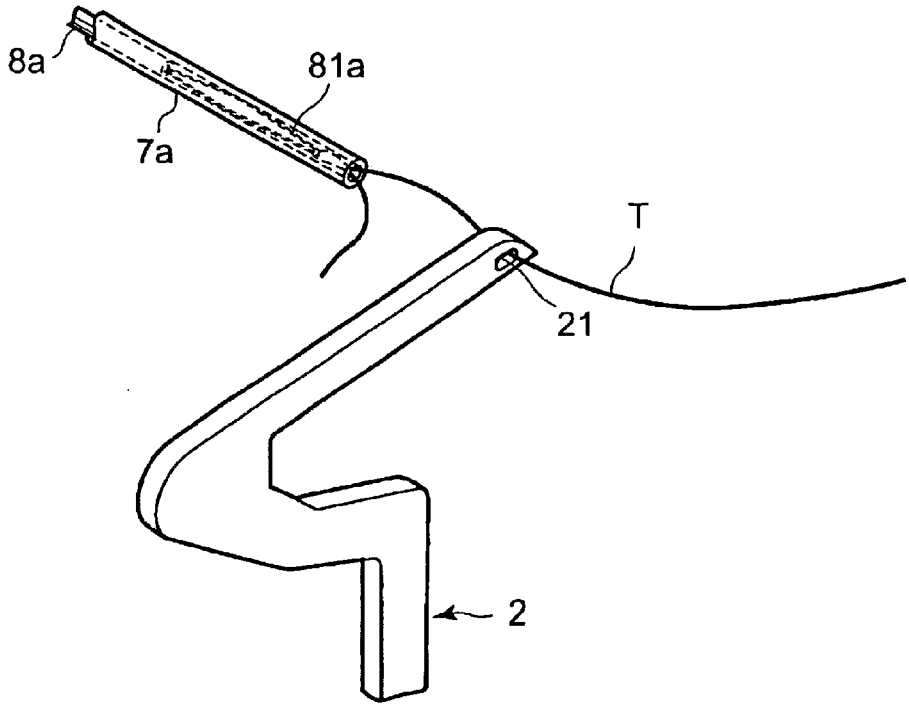
FIG. 5 is a perspective view illustrating a state in which the threading member in FIG. 4 is accommodated in the guide member.

When the threading member 8*a* is retreated so that an interval between the transmitting member 82*a* and the second support plate 6*a* is increased and the second spring 83*a* is extended to have an original shape, the first spring 72*a* is extended to push the retreat regulating member 71*a* rearward, thereby retreating the guide member 7*a* to be separated from the thread hole 21. By the rearward movement of the threading member 8*a*, the catching portion 81*a* enters the guide member 7*a* by taking the thread T as shown in FIG. 5. When the retreat regulating member 71*a* and the second support plate 6*a* come in contact with each other, the guide member 7*a* is regulated to be retreated and becomes stationary. Consequently, the thread T is inserted through the thread hole 21 of the lower looper 2.

In this case, the operation of each portion to retreat the threading member 8*a* is interlocked with an operation for advancing the threading member 8*b*. By the retreat of the threading member 8*a*, therefore, the threading member 8*b* is advanced in the same procedure as the advance operation of the threading member 8*a*.

Accordingly, when the pulse motor 9 is further driven in a reverse direction beyond an initial position and is placed in a second inserting position in which the advance regulating member 73*b* comes in contact with the erected portion of the second support plate 6*b* (S10), the pulse motor 9 is stopped (S11) and the tip potion of the guide member 7*b* is close to the thread hole 31 of the upper looper 3, and furthermore, a threading member (not shown) provided on the tip of the guide member 7*b* penetrates through the thread hole 31 and is protruded therefrom. An upper looper thread which is not shown is inserted through the threading member.

When the threading switch 100 is operated again (S12), then, the pulse motor 9 is driven in one direction (S13) and the threading member of the thread guide member 7*b* enters the thread guide member 7*b*. Consequently, the upper looper thread can be inserted through the thread hole 31. When the pulse motor 9 is placed in the initial position (FIG. 1) (S14), it is stopped (S15).

In the embodiment, thus, the moving mechanism for moving the threading members 8*a* and 8*b* and the guide members 7*a* and 7*b* along the axes of the thread holes 21 and 31 provided on the extended lines of the threading members 8*a* and 8*b* is constituted by the pulse motor 9, the driving gear 91, the rotary gear 52, the first pulley 53, the second pulley 55 and the belt 56. Even if a switching mechanism is not required, therefore, it is possible to individually operate the two threading members 8*a* and 8*b* by controlling the rotating direction of the pulse motor 9. By moving a plurality of threading members 8*a* and 8*b* by means of one moving mechanism, thus, it is possible to decrease a size and to reduce a cost.

As described above, according to the looper threading apparatus in accordance with the embodiment, the moving mechanism moves the guide members 7*a* and 7*b* and the threading members 8*a* and 8*b* with respect to the thread holes 21 and 31 provided on the extended lines of the threading members 8*a* and 8*b* so that the catching portions of the threading members 8*a* and 8*b* penetrate through the thread holes 21 and 31. The tip portions 81*a* and 81*b* of the threading members 8*a* and 8*b* thus penetrating are caused to hold the thread T, and the moving mechanism separates the threading members 8*a* and 8*b* and the guide members 7*a* and 7*b* from the thread holes 21 and 31 in the exact condition to extract the catching portions 81*a* and 81*b* from the thread holes 21 and 31 so that the thread T is also inserted through the thread holes 21 and 31 following the operation. In other words, even if the operator does not directly insert the thread T through the thread holes 21 and 31 by a manual work, it is possible to automatically insert the thread T through the thread holes 21 and 31 by simply holding the thread T in the catching portions 81*a* and 81*b* of the threading members 8*a* and 8*b*. Thus, it is possible to carry out the threading without utilizing an air pressure. Consequently, it is possible to efficiently carry out the threading work without a fear of the invasion of a foreign substance.

Moreover, the guide members 7*a* and 7*b* are supported in a plurality of points by the first support plates 4*a* and 4*b* and the second support plates 6*a* and 6*b*. Therefore, the movement of the guide members 7*a* and 7*b* can be stabilized.

In addition, the advance regulating members 73*a* and 73*b* for coming in contact with the second support plates 6*a* and 6*b* to regulate the advance of the guide members 7*a* and 7*b* are fixed to the guide members 7*a* and 7*b* in such a manner that the guide members 7*a* and 7*b* and the thread holes 21 and 31 are close to each other at a predetermined interval. Therefore, the advance positions of the guide members 7*a* and 7*b* can be set and the guide members 7*a* and 7*b* can be reliably close to the thread holes 21 and 31. Accordingly, the guide members 7*a* and 7*b* can be prevented from being excessively advanced and the guide members 7*a* and 7*b* can prevent the lower looper 2 and the upper looper 3 from being pressed.

Furthermore, the retreat regulating members 71*a* and 71*b* for coming in contact with the second support plates 6*a* and 6*b* to regulate the retreat of the guide members 7*a* and 7*b* are fixed to the guide members 7*a* and 7*b* in such a manner that the guide members 7*a* and 7*b* and the thread holes 21 and 31 are separated from each other at a predetermined interval. Therefore, the retreat positions of the guide members 7*a* and 7*b* can be set, and the guide members 7*a* and 7*b* can be prevented from being dropped from the first support plates 4*a* and 4*b* in the retreat.

Moreover, the threading members 8*a* and 8*b* are fixed to the belt 56 by the engaging members 84*a* and 84*b*. Even if a runout is generated in the threading members 8*a* and 8*b* and the guide members 7*a* and 7*b*, therefore, the belt 56 can fluctuate according to the runout, thereby correcting their runout.

The catching portions 81*a* and 81*b* of the threading members 8*a* and 8*b* have a different color from the colors of the members provided in the vicinity of the thread holes 21 and 31. Therefore, the catching portions 81*a* and 81*b* are conspicuous in the threading so that the operator can grasp the positions of the catching portions 81*a* and 81*b* at a glance.

[Second Embodiment]

Figure 7:
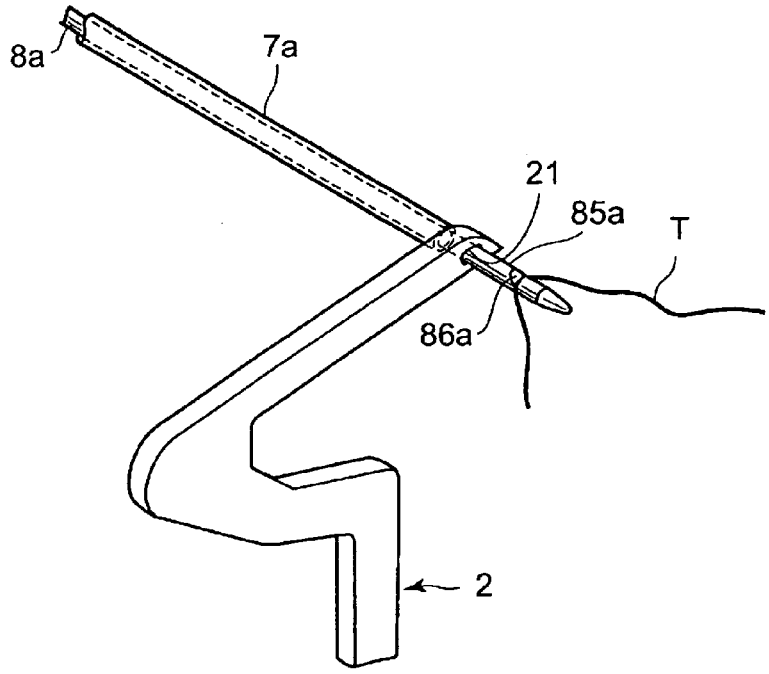
FIG. 7 is a perspective view illustrating a state in which the catching portion of the threading member in FIG. 6 is inserted through a thread hole.
Figure 8:
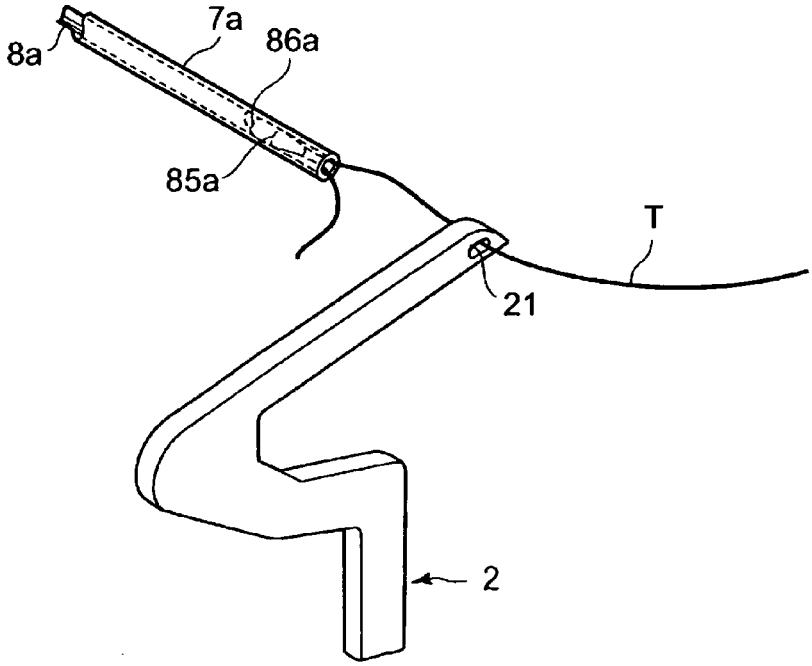
FIG. 8 is a perspective view illustrating a state in which the threading member in FIG. 7 is accommodated in a guide member.

Next, a looper threading apparatus according to a second embodiment will be described with reference to FIGS. 6 to 8. In the looper threading apparatus according to the embodiment, the catching portions of the threading members 8*a* and 8*b* are changed in the looper threading apparatus 1 according to the first embodiment, and other structures are substantially identical to those in the first embodiment. In the following description, therefore, common structures to the looper threading apparatus 1 according to the first embodiment have the same reference numerals.

Figure 6:
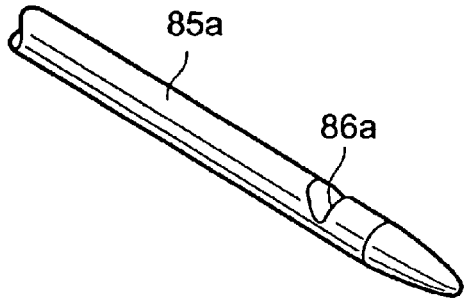
FIG. 6 is a perspective view illustrating the catching portion of a threading member provided in a looper threading apparatus according to a second embodiment.

As shown in FIG. 6, a catching portion 85*a* of the threading members 8*a* and 8*b* according to the embodiment is formed like a rod having a narrow tip and a side surface thereof is provided with a holding groove 86*a* for holding a thread T. When the catching portion 85*a* is inserted through a thread hole 21, the thread T is engaged with the holding groove 86*a* as shown in FIG. 7. By the retreat of the threading member 8*a*, then, the catching portion 85*a* takes the thread T and is accommodated in a guide member 7*a* in this condition as shown in FIG. 8. Consequently, the thread T is inserted through the thread hole 21.

The invention is not restricted to the embodiments but can be properly changed.

While the description has been given to the case in which the looper threading apparatus 1 is applied to the sewing machine comprising the lower looper 2 and the upper looper 3 in the embodiment, for example, the looper threading apparatus 1 can also be applied to a sewing machine having a multi-thread chain looper which comprises a thread hole provided to penetrate through the tip of the looper.

While the operation step is progressed every press of the threading switch 100 in the embodiment, furthermore, a separate switch may be provided to carry out an operation by a manipulation for each switch. Furthermore, a threading mode set switch may be provided to carry out the same action as that of the threading switch 100 according to the embodiment by an existing switch operation such as a sewing machine driving stop switch when a threading mode is set.

Moreover, the pulse motor 9 may be a stepping motor or a servo motor.

While the description has been given to the example in which the advance regulating member and the retreat regulating member are provided in the embodiment, moreover, a stop position may be defined by only the control of a motor stop position without providing each regulating member.

Furthermore, it is also possible to provide a clutch which is driven by a solenoid in an initial position by using a DC motor in place of the pulse motor 9, thereby blocking a portion between the same motor and the pulley 53.

Although the sewing machine motor is controlled by the operation of the threading switch 100 in such a manner that the upper and lower loopers 2 and 3 are placed in the predetermined threading positions in the embodiment, furthermore, it is also possible to rotate the main shaft of the sewing machine to place them in the same positions by hand.

While some sewing machines having the thread hole provided to penetrate through the tip of the looper comprise a thread guide device for guiding a thread inserted through the looper to a groove provided on the side surface of the looper, moreover, the guide device also includes a thread guide member through which the thread is inserted. If the thread hole of the thread guide member is caused to correspond to that of the looper when inserting the thread through the looper, therefore, the looper and the thread guide member can be threaded at a time by the looper threading apparatus 1.

While the support members for supporting the guide members 7*a* and 7*b* to freely approach and separate from the thread holes 21 and 31 provided on the extended lines of the threading members 8*a* and 8*b* are constituted by the first support plates 4*a* and 4*b* and the second support plates 6*a* and 6*b* to support the guide members 7*a* and 7*b* in two points on the moving paths for the guide members 7*a* and 7*b* in the embodiment, moreover, the support members may be formed integrally and three support portions for supporting the guide members 7*a* and 7*b* or more maybe provided. In the case in which the three support portions or more are provided, the advance regulating member is provided behind the rear one of the support portions. On the other hand, in the retreat regulating member, at least one support portion is positioned therebefore.

While the guide members 7*a* and 7*b* penetrate through the through holes 41*a* and 41*b* and the through holes 61*a* and 61*b* and are thus supported to freely approach and separate from the thread holes 21 and 31 in the embodiment, moreover, it is also possible to take any shape capable of supporting the guide members 7*a* and 7*b* to freely approach and separate from the thread holes 21 and 31. In addition, it is also possible to employ a structure in which a groove is formed on the first support plate and the second support plate and the guide member is engaged with the groove, for example.

While the second springs 83*a* and 83*b* are used as the advancing elastic members and the first springs 72*a* and 72*b* are used as the retreating elastic members in the embodiment, moreover, it is also possible to employ any elastic member which is elastically deformed by the advance of the threading members 8*a* and 8*b* as the advancing elastic member and the retreating elastic member. For example, the advancing elastic member and the retreating elastic member may be formed like a tube by rubber.

Moreover, the pulse motor 9 is used for the moving mechanism in the embodiment. Instead, it is also possible to attach one cylinder for carrying out a linear motion to the belt 56, thereby moving the threading members 8*a* and 8*b* longitudinally. Furthermore, it is also possible to attach a direct acting actuator such as a cylinder to each of the threading members 8*a* and 8*b*, thereby carrying out the longitudinal motion.

According to the first aspect of the invention, the catching portion of the threading member penetrating through the thread hole is caused to hold the thread and the moving mechanism separates the threading member and the guide member from the thread hole in the exact condition, and the catching portion is extracted from the thread hole so that the thread is also inserted through the thread hole following the operation. In other words, even if an operator does not directly insert the thread through the thread hole by a manual work, it is possible to automatically insert the thread through the thread hole by simply holding the thread in the catching portion of the threading member. Thus, the threading can be carried out without utilizing an air pressure. Consequently, it is possible to efficiently carry out the threading work without a fear of the invasion of a foreign substance.

According to the second aspect of the invention, the catching portion of the threading member can penetrate through the thread hole even if it has a larger outer shape than the outer shape of the thread hole. After the penetration, furthermore, the catch portion of the tip portion is restored to have an original shape and can therefore be caused to hold the thread easily so that a workability can be enhanced.

Moreover, the support member is provided with a plurality of support portions for supporting the guide member. Therefore, the movement of the guide member can be stabilized.

According to the third aspect of the invention, the advance position of the guide member can be set and the guide member and the thread hole can be reliably close to each other. Accordingly, it is possible to prevent the guide member from being excessively advanced and to prevent the guide member from coming in contact with the looper to carry out pressing.

According to the fourth aspect of the invention, the retreat position of the guide member can be set and the guide member can be prevented from being dropped from the support portion in the retreat.

According to the fifth aspect of the invention, when the threading member is advanced by the moving mechanism, the transmitting member presses the advance regulating member through the advancing elastic member with the advance. By the pressing, the guide member can be advanced. In this case, the retreat regulating member is also advanced to elastically deform the retreating elastic member. When the threading member is retreated by the moving mechanism, then, the press of the advance regulating member by the transmitting member is released so that the guide member tries to stay in that place. Since the retreating elastic member is elastically restored to push the retreat regulating member rearward, however, the guide member is also retreated. By moving only the threading member, thus, it is possible to move the guide member longitudinally.

According to the sixth aspect of the invention, even if the runout is generated in the threading member and the guide member, the belt can fluctuate according to the runout, thereby correcting their runout.

According to the seventh aspect of the invention, the operator can see the catching portion taking the shape of a closed loop to be the largest. Consequently, it is possible to easily carry out a work for causing the catching portion to hold the thread.

According to the eighth aspect of the invention, the catching portion of the threading member is conspicuous. Consequently, the operator can grasp the position of the catching portion at a glance.

According to the ninth aspect of the invention, the threading can be carried out for a plurality of loopers in a short time.

According to the tenth aspect of the invention, it is possible to decrease a size and to reduce a cost.

What is claimed is:

1. A looper threading apparatus, for threading for a thread hole provided on a looper to be swung to form a stitch, comprising:

a threading member for holding a thread in a tip portion and inserting the thread through the thread hole of the looper;

a guide member for movably accommodating the threading member therein and guiding the threading member to the thread hole;

a support member for supporting the guide member to freely approach and separate from the thread hole provided on an extended line of the threading member accommodated by the guide member; and a moving mechanism for moving the threading member and the guide member along an axis of the thread hole provided on the extended line, wherein the moving mechanism moves the guide member and the threading member with respect to the thread hole provided on the extended line in such a manner that the tip portion of the threading member penetrates through the thread hole.

2. The looper threading apparatus according to claim 1, wherein the tip portion of the threading member is formed like a closed loop to be extendable, and the support member includes a plurality of support portions for supporting the guide member in order to support the guide member in a plurality of points on a moving path for the guide member.

3. The looper threading apparatus according to claim 1, wherein an advance regulating member for coming in contact with at least one of the support portions to regulate an advance of the guide member is fixed to the guide member in order to cause the guide member and the thread hole to be close to each other at a predetermined interval.

4. The looper threading apparatus according to claim 1, wherein a retreat regulating member for coming in contact with at least one of the support portions to regulate a retreat of the guide member is fixed to the guide member in such a manner that the guide member and the thread hole are separated from each other at a predetermined interval.

5. The looper threading apparatus according to claim 4, wherein the advance regulating member is provided behind a rear one of the support portions and the retreat regulating member is provided in such a manner that at least one of the support members is positioned therebefore, the threading member includes a transmitting member for transmitting a movement carried out by the moving mechanism to the guide member, an advancing elastic member having an elasticity is provided between the advance regulating member and the transmitting member, and a retreating elastic member having the elasticity is provided between the support member positioned before the retreat regulating member and the retreat regulating member.

6. The looper threading apparatus according to claim 1, wherein the moving mechanism includes:

a motor;

a first pulley to be rotated and driven by the motor;

a second pulley which is provided apart from the first pulley and is rotatable;

a belt provided over the first pulley and the second pulley; and an engaging member for fixing the threading member to the belt in order to freely adjust a position.

7. The looper threading apparatus according to claim 2, wherein the thread hole is formed like a slot in an almost horizontal direction in such a manner that the tip portion taking a shape of the closed loop is almost horizontal when the threading member is inserted therethrough.

8. The looper threading apparatus according to claim 1, wherein the tip portion of the threading member has a different color from colors of members provided in the vicinity of the thread hole.

9. The looper threading apparatus according to claim 1, wherein when a plurality of loopers is provided, the threading member, the guide member and the support member are provided in plural sets for each of the loopers.

10. The looper threading apparatus according to claim 9, wherein the threading members are moved by one moving mechanism.

* * * * *